United States Patent [19]

Hughes

[11] Patent Number: 4,732,331

[45] Date of Patent: Mar. 22, 1988

[54] SONIC COMPACTOR

[75] Inventor: Joel Hughes, Wilmington, N.C.

[73] Assignee: Container Products Corp., Wilmington, N.C.

[21] Appl. No.: 31,359

[22] Filed: Mar. 30, 1987

[51] Int. Cl.[4] ..... B02C 19/18

[52] U.S. Cl. ..... 241/1; 100/39; 100/98 R; 241/101.2; 241/301; 241/DIG. 14; 241/DIG. 38

[58] Field of Search ..... 100/39, 98 R, 94, 269 R, 100/270; 241/1, 301, 101.2, 99, DIG. 14, DIG. 38

[56] References Cited

U.S. PATENT DOCUMENTS 3,481,268 12/1969 Price et al. ..... 100/98 R
3,537,655 11/1970 Gustafson ..... 241/1
3,615,084 10/1971 Wasinger ..... 100/98 X
3,807,296 4/1974 Eck ..... 241/101.2 X

FOREIGN PATENT DOCUMENTS 2427760 1/1976 Fed. Rep. of Germany .... 100/98 R

*Primary Examiner*—Mark Rosenbaum

[57] ABSTRACT

A waste compactor utilizing the combined forces of compression and vibration for reducing, leveling and compacting waste within a container. The pressure force is expelled through a guided hydraulic ram assembly, the pressurized movement of which is coordinated with an applied vibrating energy developed through a mechanical vibrator and/or sonic frequency emitter, the rate and intensity of which encompasses a varying range. The sonic vibrating energy generator may be carried by and movable with the compacting ram or it may be embedded in the base platform of the compactor.

18 Claims, 5 Drawing Figures

SONIC COMPACTOR

PRIOR ART DEVICES

In the past sound frequency applicators for treating waste effluences were primarily for the purposes of reducing the particle size of the waste before compression and disposal. Such a system was disclosed in U.S. Pat. No. 3,537,655.

Other methods included the use of shock waves, such as those generated by highly pressurized gas caused to escape at supersonic speeds before impaling the waste material subsequent to compaction. This method normally required pre-heating or liquid immersion of the material to be pulverized. Such a method was set forth in U.S. Pat. No. 2,997,245.

SUMMARY OF THE INVENTION

The principal object of this invention is to subject compactable waste material simultaneously or substantially simultaneously to compaction and high intensity frequencies to disintegrate and distribution within the compacting container the volume of material to be disposed.

The operation of the invention will utilize high intensity sound frequencies ranging from the low audible frequencies (infrasonic/subsonic) of approximately 20 Hz. up through and into nonaudible frequencies (ultrasonic) of approximately 100K Hz.

The preferred mode of operation consists of progressing through the selected range of frequencies while the material is placed under continuing compaction forces. This combination of force and frequencies results in even distribution of the material throughout the container by the vibrational forces, disintegration of the material by the sonic frequencies, and further volume reduction of the material by the compaction forces.

The novel construction by which the objects of the invention are achieved does not require the use of liquids or fluids as an assist in volume reduction or as a vehicle for transportation of the waste material to be reduced in volume. The structure does not require any pretreatment of the material to be reduced in volume by heat or otherwise.

The apparatus also includes an exhaust system which creates a negative atmosphere within the compacting chamber so that all fumes and gases created by the compacting action may be filtered before dispensing into the atmosphere.

BRIEF DESCRIPTION OF THE DRAWINGS

The invention will be best understood by reference to the accompanying drawings which illustrate the preferred form of construction and mode of operation by which the objects of the invention are achieved and in which.

GENERAL DESCRIPTION OF THE INVENTION

Figure 1:
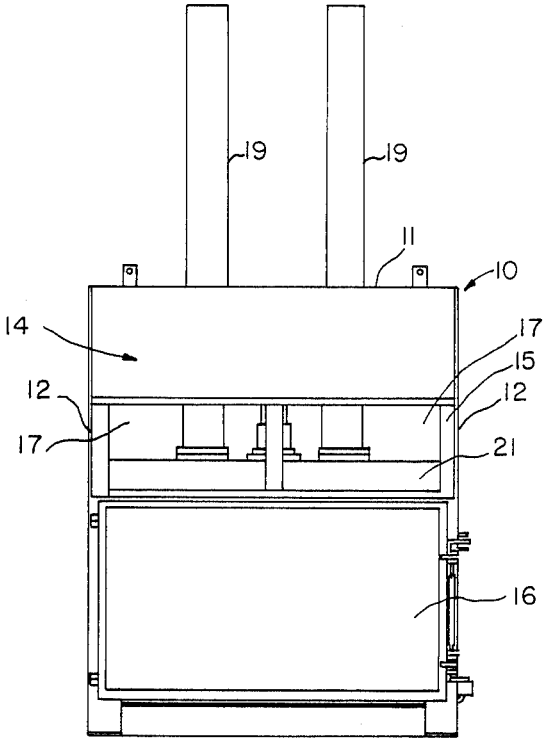
FIG. 1 is a front elevational view of the compactor of this invention.

The compactor 10 of this invention as illustrated in the drawings consists of a cabinet-like housing including a top wall 11, side walls 12, a rear wall 13 and a partial front wall 14. To complete the closure for the front of the cabinet there is provided an uppr door 15 and a lower door 16. As shown in FIG. 1 the upper door 15 consists of transparent panels 17, that are arranged for vertical movement to a position to overlie the partial front wall 14 when the cabinet compactor is opened to receive a waste container.

Figure 2:
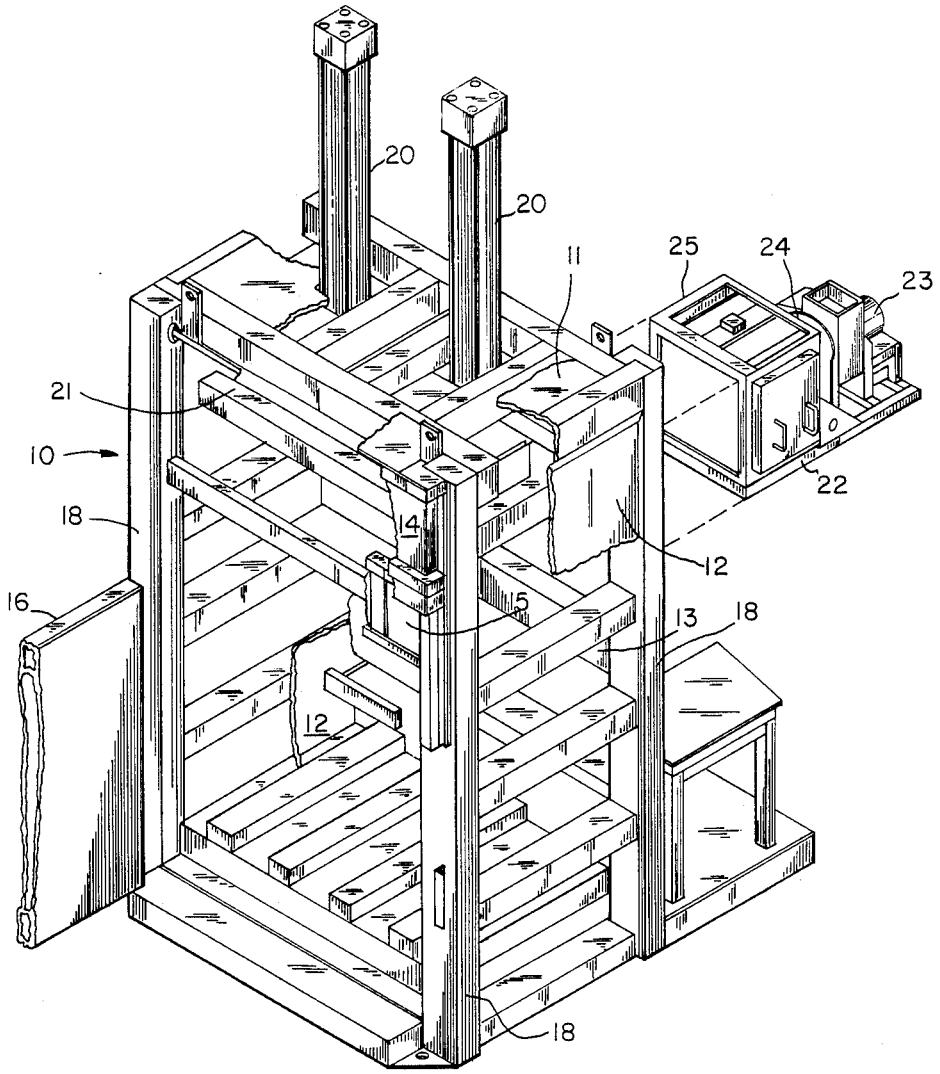
FIG. 2 is a detailed sectional view of the compactor primarily showing the internal frame structure of the unit.

The lower door 16 is hingedly connected along one vertical edge to the frame structure of the compactor and is adapted to be moved horizontally about a vertical axis into an open position as illustrated FIG. 2.

The construction of the cabinet-like housing consists of four corner posts 18. The forward pair of which provides support for the partial front wall 14 and the doors 15 and 16. These corner posts support and are covered by the cabinet walls as here and before identified, which is constructed from stainless steel panels.

Projecting through the top wall 11 of the compactor 10 are a pair of vertically extending hollow sleeves 19 which contain elongaged hydraulic pistons 20. The ends of the pistons 20 tht project into the cabinet are connected to a horizontally disposed compactor ram 21.

Mounted on the rear wall 13 exteriorly of the compactor 10 is a horizontal shelf 22 that supports an electric motor 23, which in turn is operatively connected to an air blower 24. The air blower in turn has open communication with an evacuation filter containing cabinet 25. The cabinet 25 in turn has open communication with the interior of the compactor 10 through a suitable opening formed in the rear wall 13.

When the electric motor 23 operates the blower 24 the atmospheric volume within the closed cabinet will be evacuated creating a negative atmospherical pressure within the compactor for effectively exhausting fumes and gases therefrom without permitting its escape into the ambient atmosphere without first being filtered.

The principal object of this invention is to provide a sonic compactor and as such the most efficient mechanism for achieving the desired operation is through a novel construction of the compacting ram 21 and/or a waste container supporting platform 26.

Figure 3:
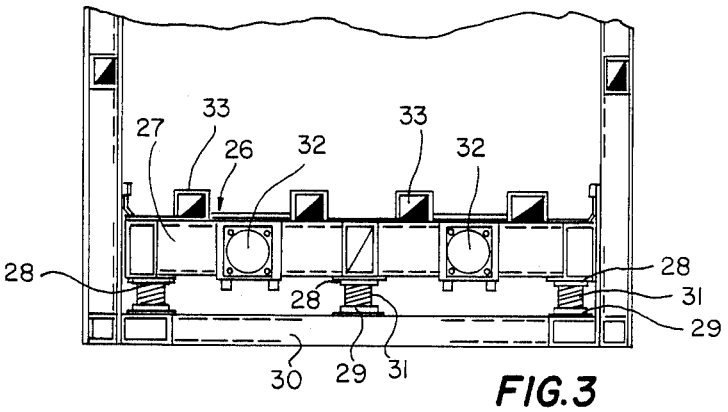
FIG. 3 is a fragmentary sectional detailed view of the vibrating platform of this invention and its mounting.

As viewed in FIG. 3 the waste container platform 26 consists of a series of rectangularly arranged hollow beams 27, which have fastened to the underside thereof a series of elongated supporting plates 28. Positioned beneath these supporting plates 28, between like supporting plates 29, mounted on top of the cabinet base 30, are shock absorbing members 31. As illustrated, but not in a limiting sense, the shock absorbing members 31 are compression springs providing sufficient deflection and maximum capacity load.

Extending between the beam construction 27 of the platform 26 are a series of vibrators 32. These vibrators 32 may be of any construction such as electrically driven eccentrics.

A series of container supporting risers 33 are mounted on the top exposed surface of the platform 26 for supporting thereon a waste container.

In operation when the cabinet doors 15 and 16 are closed and locked and the exhaust blower 24 is energized the pistons 20 will be hydraulically activated to move the ram 21 within the waste container for effecting compression of the waste therein. The vibrators 32 will be energized and their action will impart vibration to the platform 26 as well as to the waste container and the waste therein.

Figure 4:
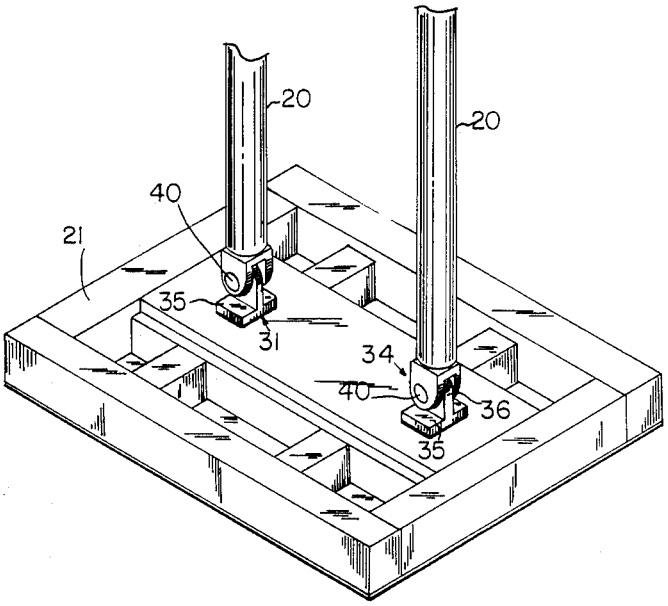
FIG. 4 is a perspective view of the compactor ram of this invention.
Figure 5:
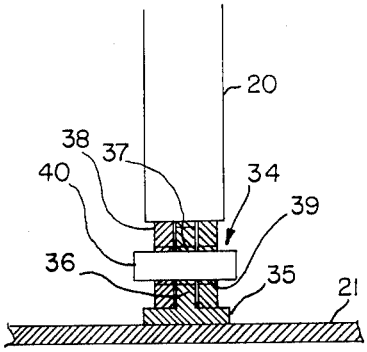
FIG. 5 is a fragmentary detailed sectional view of the compactor ram mounting to the hydraulic cylinder.

It is imperative that the vibrational forces created during operation of the compactor not be transmitted to the hydraulic pistons 20. To eliminate the vibration the pistons 20 are provided with a clevis mounting 34 as shown in FIGS. 4 and 5. This clevis mounting 34 includes a ram mount 35 that provides a vertical post 36 having a central opening 37 extending horizontally therethrough. The piston 20 will provide a bifurcated depending mount 38, which like the post 36 provides aligned horizontal openings 39. A vibration dampening pin 40 projects through the openings 37 and 39 to connect the ram 21 to the pistons 20. This dampening pin may be made of suitable vibration absorbing material such as rubber and the like.

While there has been described a volume reduction of waste material by the simultaneously compacting and vibrational forces, with the vibrational forces being created by mechanical means, it should be noted that the same result can be achieved by utilizing ultrasonic transducers. These transducers will emit high intensity sound frequencies ranging from the low audible frequencies, infrasonic/subsonic, of approximately 20 Hz. up through and into non-audible frequencies, ultrasonic of approximately 100K Hz.

The means or method to produce the sonic or phonic signals will include, but are not necessarily limited to, power processes using solid electromechanical transducers of the piezoelectric or magnetostrictive type to convert electrical energy to vibratory mechanical energy.

When the compactor utilized sound frequencies for inducing volume reduction it is proposed that the mode of operation will consist of progressing through a range of frequencies, starting with a low frequency, high intensity signal, with the material being placed under increasing compression induced by the compactor ram 21. The process will continue through a high frequency, high intensity signal and full stroke compression. Thus the output frequency will change its resonance in ratio to changes in the resistance to the compression forces. As such the change in the effected mass by the compression force is acted upon by an optimum resonant operation.

This combustion of compression forces and frequency variations results in even distribution of the waste material throughout the container which is enhanced by the disintegration of the mass volume during the compacting process.

It has also been found that the mode of operation abovedescribed can be achieved through the physical incorporation of the signal transducers within the compactor ram 21 as well as physical embodiment within the platform 26, with the size of the transducers and their location varying so as to respond to the ram size and type of material to be compacted.

The compactor ram 21 can be quickly vertically oscillated by a vibrating moving means so as to create a continuous tapping force upon the waster material, thus creating vibrational forces therein to aid in the distribution, disintegrating and compacting of the material while under a continuing compacting force.

From the foregoing there has been described a means and method for volume reduction by combining compression forces simultaneously with sonic, ultrasonic, and ultraphonic frequencies, the latter producing the necessary disintegration and mass leveling of the waste during compression.

Having thus described the invention what is claimed as new and desired to be protected by Letters Patent is:

1. An apparatus for disintegrating, leveling and compacting waste material within a waste container, comprising, (a) a cabinet providing internal access through a lockable door for the reception of a waste container, (b) a movable waste compression member within said cabinet and movable in contact with the waste material within the waste container, positioned within said cabinet, (c) means moving said compressing member through reciprocal directions within said cabinet, (d) a platform within said cabinet for supporting the waste container, (e) means creating vibrational forces upon the waste within the waste container during compaction threof by said compressing member, (f) means resiliently mounting said platform within said cabinet so as to prevent vibrational forces from being transmitted from said platform to said cabinet, and (g) means resiliently connecting said compressing member to said moving means so as to prevent vibrational forces from being transmitted from said waste material within the container through the compressing member onto said moving means.

2. An apparatus as defined by claim 1 wherein said means creating vibrational forces is carried by and operatable upon said platform.

3. An apparatus as defined by claim 2 including an exhaust system for creating a negative pressure within such cabinet during compacting of the waste mass within the waste container.

4. An apparatus as defined by claim 2 wherein said means creating vibrational forces upon said platform include a mechanical mechanism.

5. An apparatus as defined by claim 2 wherein said means creating vibrational forces upon said platform include a sonic frequency signal generator.

6. An apparatus as defined by claim 5 wherein said vibrational forces acting upon said platform range from low audible frequencies of approximately 20 Hz. through and into non-audible frequencies of approximately 100K Hz.

7. An apparatus as defined by claim 1 wherein said means creating vibrational forces is carried by and operatable upon said compression member.

8. An apparatus as defined by claim 7 including an exhaust system for creating a negative pressure within such cabinet during compacting of the waste mass within the waste container.

9. An apparatus as defined by claim 7 wherein said means creating vibrational forces upon said compression member include a sonic frequency signal generator.

10. An apparatus as defined by claim 9 wherein said vibrational forces acting upon said compression member range from low audible frequencies of approximately 20 Hz. through and into non-audible frequencies of approximately 100K Hz.

11. An apparatus as defined by claim 1 wherein said means for creating vibrational forces include a mechanical mechanism.

12. An apparatus as defined by claim 1 wherein said means creating vibrational forces include a sonic frequency signal generator.

13. An apparatus as defined by claim 12 wherein said vibrational forces created by said sonic generator range from low audible frequencies of approximately 20 Hz. through and into non-audible frequencies of approximately 100K Hz.

14. An apparatus as defined by claim 1 including an exhaust system for creating a negative pressure within such cabinet during compacting of the waste mass within the waste container.

15. In a method for treating contained waste masses, the steps consist of disposing the waste in an open container, placing the container in a cabinet and exhausting the atmosphere therefrom so as to create a negative pressure chamber surrounding the open container, subjecting the waste within the container to compression forces while simultaneously imparting vibratory energy to the waste in varying frequencies beginning with low frequency, high intensity vibrational forces during initial compression of the waste mass within the container.

16. The method of claim 15 in which the vibratory energy is created so as to act upon the waste container.

17. The method of claim 15 in which the vibrational energy is created upon the waste mass through the compression force as it compacts said waste mass within the container.

18. The method of claim 15 in which the vibrational energy upon the waste mass is created by ultrasonic and ultraphonic sound frequencies varying in range during compression of the waste mass within the container.

* * * * *